US008517491B2

(12) United States Patent
Netsu

(10) Patent No.: US 8,517,491 B2
(45) Date of Patent: Aug. 27, 2013

(54) PRINTING APPARATUS AND DRIVING METHOD OF A LIQUID EJECTING HEAD

(75) Inventor: Hiroshi Netsu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 307 days.

(21) Appl. No.: 13/024,738

(22) Filed: Feb. 10, 2011

(65) Prior Publication Data

US 2011/0205269 A1 Aug. 25, 2011

(30) Foreign Application Priority Data

Feb. 19, 2010 (JP) ..... 2010-035127

(51) Int. Cl.
*B41J 29/38* (2006.01)
*B41J 2/05* (2006.01)

(52) U.S. Cl.
USPC ..... 347/10; 347/59

(58) Field of Classification Search
CPC ..... B41J 2/1404; B41J 2/1412
USPC ..... 347/9–12, 19, 58, 59
See application file for complete search history.

(56) References Cited

U.S. PATENT DOCUMENTS 4,584,573 A 4/1986 Ito
6,290,334 B1 * 9/2001 Ishinaga et al. ..... 347/59
7,815,272 B2 * 10/2010 Kasai et al. ..... 347/12

FOREIGN PATENT DOCUMENTS

JP 58-016379 A 1/1983
JP 61-22958 A 1/1986

* cited by examiner

*Primary Examiner* — An Do
(74) *Attorney, Agent, or Firm* — Fitzpatrick, Cella, Harper & Scinto

(57) ABSTRACT

In a highly integrated printing head forming an image with continuously ejected ink droplets, there are disadvantages of a high cost for a control circuit and wirings due to a large number of the wirings for charging electrodes, a difficulty for ensuring electrical insulation between the wirings having a narrow pitch and a high density, and an induced voltage in the wirings due to the mutual induction therebetween. Therefore, the present invention includes dividing a plurality of nozzles into a plurality of groups, shifting production timings between the groups, and applying a charging voltage via common wirings to which the charging electrodes of different groups corresponding to each other are commonly connected.

10 Claims, 10 Drawing Sheets

PRINTING APPARATUS AND DRIVING METHOD OF A LIQUID EJECTING HEAD

BACKGROUND OF THE INVENTION

1. Field of the Invention

The present invention relates to a printing apparatus and a driving method of a liquid ejecting head used therefore.

2. Description of the Related Art

An ink jet printing apparatus (hereinafter, also referred to as a "head") for ejecting ink so as to print is known as a liquid ejecting head. In this type of head, for example, a head continuously ejecting pressurized ink from a nozzle and causing the pressurized ink to oscillate so as to produce liquid droplets is known. In this head, ink droplets unused for printing an image are electrically charged by a charging electrode and deflected in a flying direction thereof by a deflecting electrode so as to retrieve them. On the other hand, ink droplets used for printing an image go straight and land on a print medium without being charged and deflected so as to form an image. In a printing apparatus being capable of quickly printing at a high quality, it is necessary for a large number of nozzles to be integrated at a high density. If the above described charging electrode is arranged with respect to each of the large number of nozzles, respectively, the same number of control circuit outputs for the charging electrodes and wirings for connecting them to the charging electrodes as that of the nozzles are needed. A control voltage applied to the charging electrodes is generally a relatively high voltage, such as several tens to several hundreds of volts. Therefore, forming the electric wirings at a narrow pitch leads to problems such as it being difficult to ensure electrical insulation between the electric wirings, and voltage being induced in the wirings due to the mutual induction therebetween. In addition, the large number of the electric wirings connecting between the charge electrodes and the control circuit increases the costs for the electric wirings and the control circuit. To prevent these problems, Japanese Patent Laid-open No. S61-022958 (1986) discloses a technique to reduce mutual induction between wirings for charging electrodes by forming them alternately in opposite directions to broaden the pitch therebetween. Japanese Patent No. S58-016379 (1983) discloses a technique to reduce the number of wirings for signals and to supply electric power by forming charging electrodes, and shift registers and latch circuits of the control circuit corresponding to the charging electrodes, in a single semiconductor device.

In more highly integrated head, it is required to further broaden a pitch between wirings to reduce mutual induction therebetween. On the contrary, it is also required to reduce output points of a control circuit and connection points between the control circuit and charging electrodes to decrease the cost for controlling voltage applied to the charging electrodes.

SUMMARY OF THE INVENTION

It is an object of the present invention to reduce the number of outputs of a control circuit for controlling voltage applied to charging electrodes in a liquid ejecting head and the number of wirings for connecting the charging electrodes to the control circuit.

The present invention provides a printing apparatus including, a liquid ejecting head having a plurality of nozzles having a plurality of first nozzles belonging to a first group and a plurality of second nozzles belonging to a second group, a driving unit configured to cause liquid ejected from each of the plurality of nozzles to fly as a liquid droplet, the driving unit having a first driving unit corresponding to the plurality of first nozzles and a second driving unit corresponding to the plurality of second nozzles, a plurality of charging electrodes configured to selectively charge flying liquid droplets from each of the plurality of nozzles, a deflecting electrode configured to form an electric field to deflect each liquid droplet charged by each of the plurality of charging electrodes and a plurality of common wirings, each of the plurality of common wirings being electrically connected commonly to each of the plurality of first charging electrodes and each of the plurality of second charging electrodes, and a controller configured to control so as to drive the first driving unit and the second driving unit with different phases from each other, and apply charging voltage to each of the plurality of the first charging electrodes and each of the plurality of the second charging electrodes via each of the plurality of the common wirings.

Further features of the present invention will become apparent from the following description of exemplary embodiments (with reference to the attached drawings).

DESCRIPTION OF THE EMBODIMENTS

Figure 1:
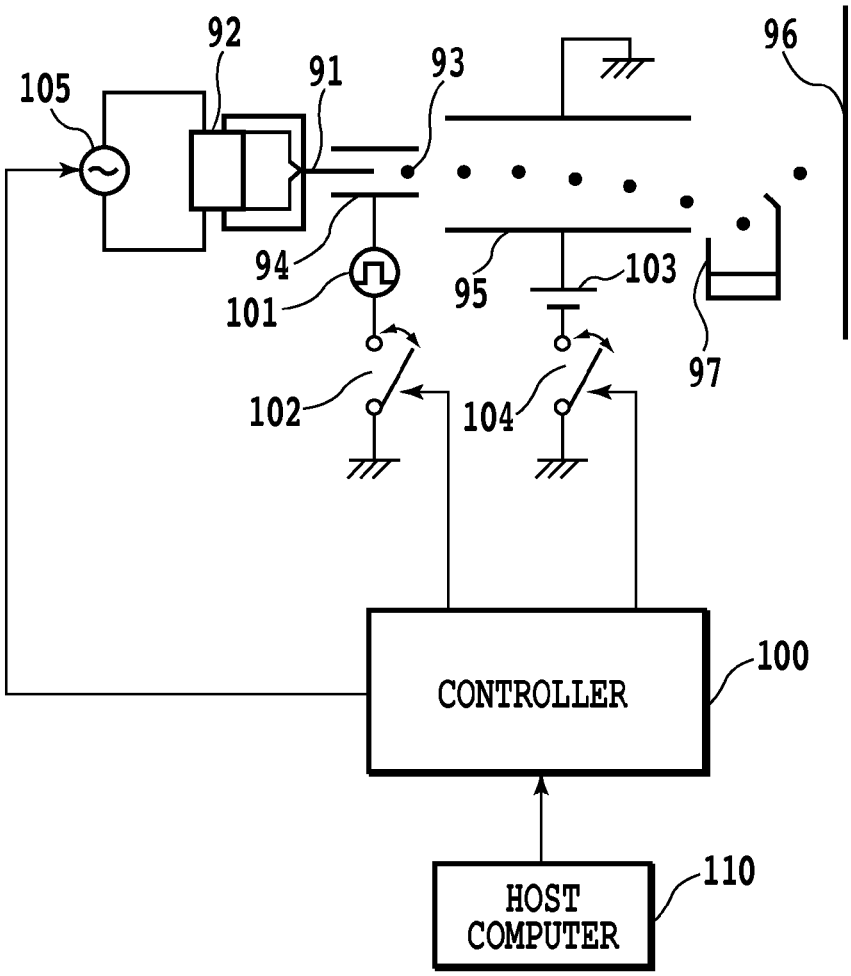
FIG. 1 is a schematic view showing a substantial part of a printer to which the present invention is applied.

An embodiment of the present invention will be described below in detail with reference to the attached drawings. FIG. 1 is a view for illustrating an operating principle of a printing head, i.e. a liquid ejecting head, of a printer as a printing apparatus to which the present invention is applied. The printer continuously ejects ink as pressurized liquid from a nozzle 91 and oscillates it with a piezoelectric element 92, thereby producing liquid droplets 93. On the other hand, a liquid droplet unused for printing among the droplets 93 produced by the piezoelectric element 92 is selectively charged with a charging electrode 94. A flying trajectory of the charged droplet is deflected by an electric field formed by a deflecting electrode 95 so that the charged droplet is collected in a gutter 97. A liquid droplet used for printing among the droplets 93 produced by the piezoelectric element 92 goes straight without deflection and lands on a print medium 96 so as to form an image thereon, because it is not charged. It should be noted that the print medium 96 is conveyed by a conveying unit 98 in a predetermined direction with respect to the printing head. A controller 100 is configured with required hardware such as a CPU, a ROM and a RAM, and required software. The controller 100 transmits and receives data to and from a host PC 110, turns on a switch 104 during printing and controls an on/off switch 102 of the charging electrode 101 in accordance with data from the host PC 110. Thus, charging voltage applied to the charging electrode 94 is controlled. Additionally, the controller 100 controls electric power supply 105 for exciting the piezoelectric element 92 so as to keep the liquid droplets constant in size even if a condition of the liquid such as viscosity varies. The host PC 110 converts image data to printing data and provides the controller with them. It should be noted that the printer is actually provided with a printing head having a plurality of nozzles, a plurality of charging electrodes and a plurality of piezoelectric elements.

Figure 2:
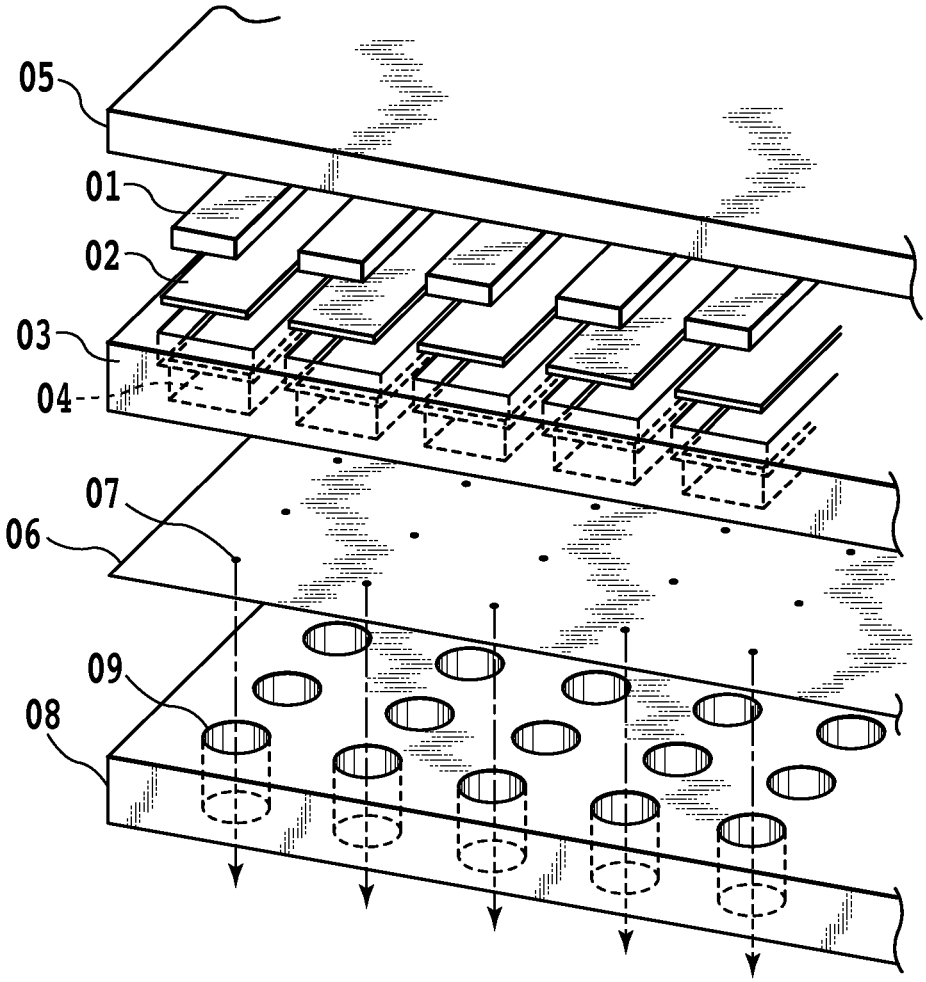
FIG. 2 is a perspective view showing an example of a printing head to which the present invention is applied.
Figure 3A:
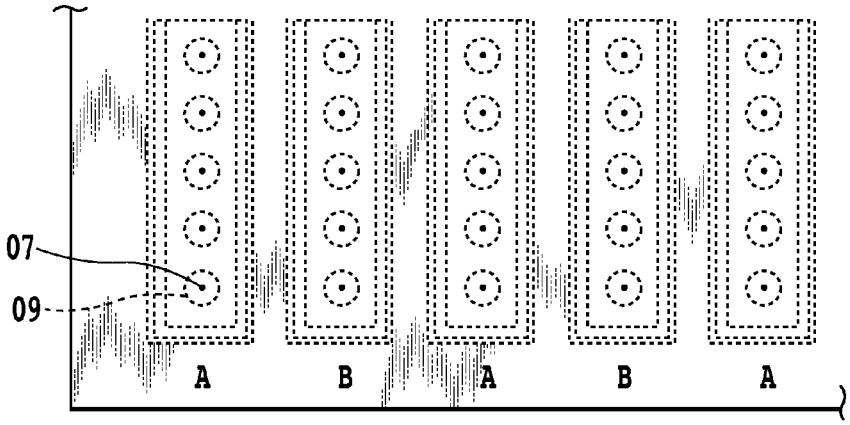
FIG. 3A is a top view of the printing head in FIG. 2.
Figure 3B:
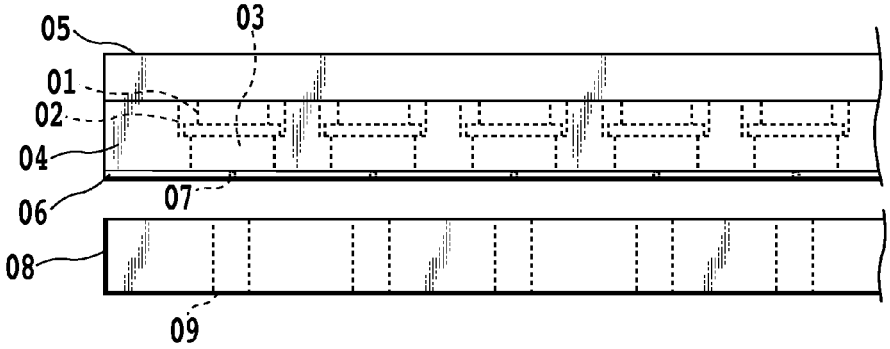
FIG. 3B is a side view of the printing head in FIG. 2.
Figure 4:
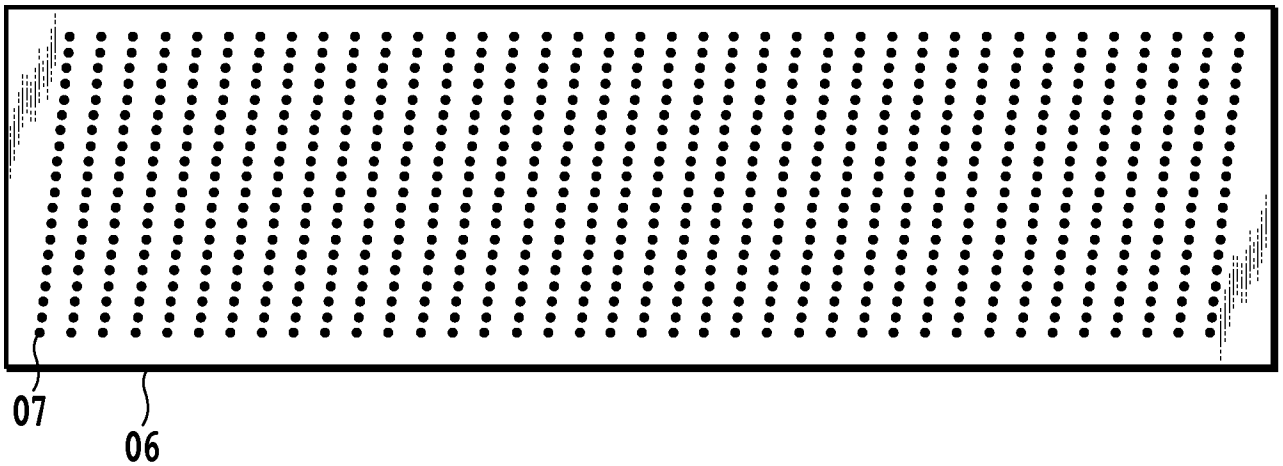
FIG. 4 is a view showing a nozzle arrangement of the printing head in FIG. 2.

FIG. 2 is an exploded perspective view of a printing head to which the present invention is applied. FIGS. 3A and 3B are top and side views of the printing head. FIG. 4 is a plan view showing a nozzle arrangement of the printing head in FIG. 2

Reference numeral 01 indicates a piezoelectric element which is an electrostrictive element for providing an oscillation to produce droplets from ink. Reference numeral 02 indicates an oscillation plate for transmitting oscillation of the piezoelectric element 01 to ink as pressure oscillation. Reference numeral 03 indicates a frame forming a liquid chamber. Reference numeral 04 indicates the liquid chamber filled with ink. Reference numeral 05 indicates a ceiling plate holding the piezoelectric element 01 in the frame 03. Reference numeral 06 indicates an orifice plate having nozzles 07 formed therethrough and adhered to the frame 03. Reference numeral 07 indicates a nozzle ejecting ink. Reference numeral 09 indicates a charging electrode providing ink droplets with electric charge so as to electrically charge them.

Pressurized ink is supplied to the liquid chamber 04 from pressurizing means such as a pump not shown in the figure and continuously ejected from the nozzle 07 of the orifice plate 06. Oscillation of the piezoelectric element 01 caused by application of excitation voltage thereto causes the oscillation plate to oscillate, so that pressure fluctuation is generated in the ink in the liquid chamber 04, thereby providing the continuously ejected ink with oscillation. The oscillation separates a liquid droplet from the ink in a flying direction when passing through the charging electrode 09. The production of the liquid droplet occurs at the same frequency as the excitation voltage applied to the piezoelectric element 01. A position where the production of the liquid droplet lands varies depending on an ejection velocity, amplitude of the oscillation, viscosity, surface tension and the like of the ink. There is a phase difference between the excitation voltage for the piezoelectric element 01 and production timing of liquid droplet. The phase difference can be kept constant by constantly maintaining the above items which affect the production timing of liquid droplet.

When voltage is applied to ink column in the charging electrode 09, electric current flows through the conductive ink so that electric charges with the opposite polarity to the charging electrode 09 are induced on the surface of the ink column. The separated ink droplet holds the electric charges and flies. An ink droplet produced when applying voltage to the charging electrode 09, which has electric charges, flies and is deflected by an electric field formed by a deflecting electrode not shown in FIG. 2 so as to be collected in the above gutter 97. An ink droplet produced when not applying voltage to the charging electrode 09, which has no electric charge, goes straight without deflection by the electric field and lands on a printing medium so that an image is formed. As described above, it is possible to form an image by controlling the charging voltage applied to the charging electrode 09 arranged with respect to each nozzle in accordance with image data.

Next, a control method according to an embodiment of the present invention will be described.

A relationship between a phase of excitation voltage for the piezoelectric element 101 and production timing of a liquid droplet can be kept constant. Thus, changing the phase of the excitation voltage for the piezoelectric element 01 between the liquid chambers 04 allows production timing of liquid droplet between the correspondent nozzles 07 to be changed with respect to each other. Accordingly, a common wiring for applying the charging voltage can be time-shared between the charging electrodes 09 corresponding to nozzles 07, which have mutually different production timing of liquid droplet from each other. Hereinafter, an example will be described, where a plurality of nozzles are divided into two groups, and a common wiring for applying charging voltage is time-shared between two charging electrodes 09, one of which belongs to one of two groups, and the other of which belongs to the other of the two groups.

Figure 5:
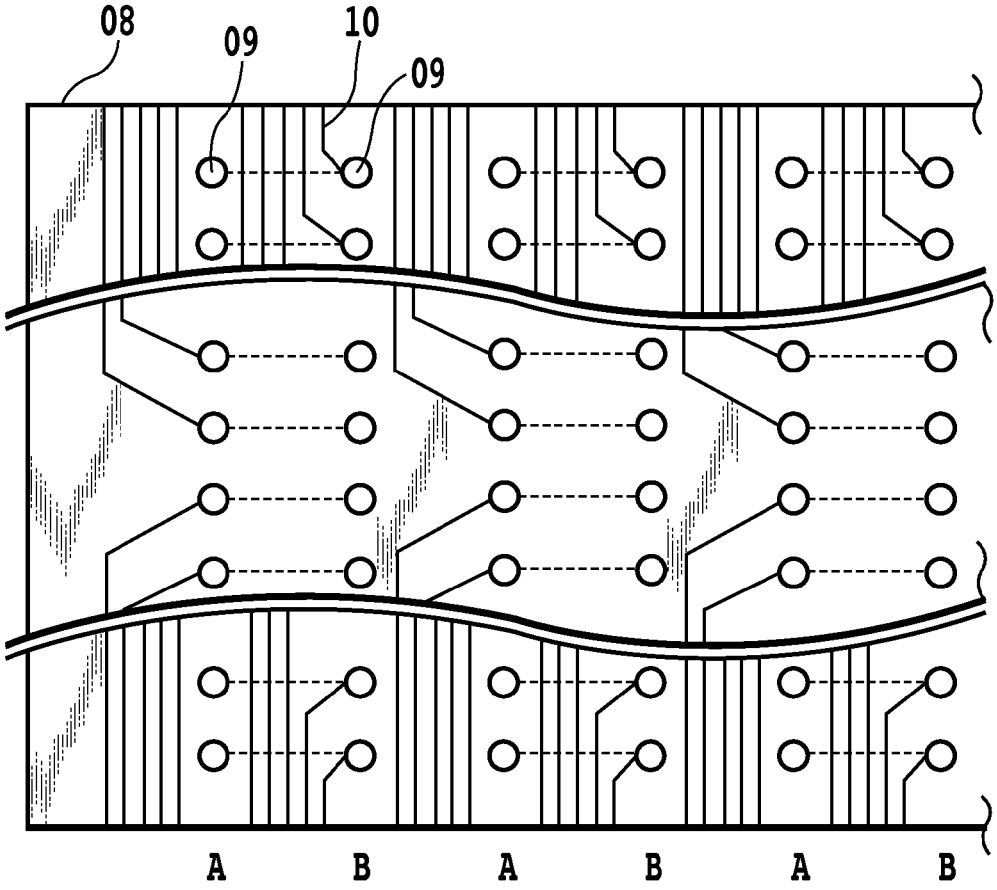
FIG. 5 is a plan view showing an example of charging electrodes and wirings.

As shown in FIGS. 3A, 3B and 4, a plurality of nozzle arrays, each of which has a plurality of nozzles, are arranged on a printing head. The nozzle arrays are oscillated by common piezoelectric elements 01 at a constant frequency, respectively. The plurality of nozzle arrays are alternately divided into an A-array group (a first group) and a B-array group (a second group). As shown in FIG. 5, each charging electrode 09 corresponding to each nozzle in one nozzle array, which belongs to the A-array group, and each charging electrode 09 corresponding to each nozzle in the nozzle array adjacent to the one nozzle array, which belongs to the B-array group, are electrically connected commonly to one of the common wirings 10, respectively, and the respective wirings 10 are extended to outside.

Figure 6:
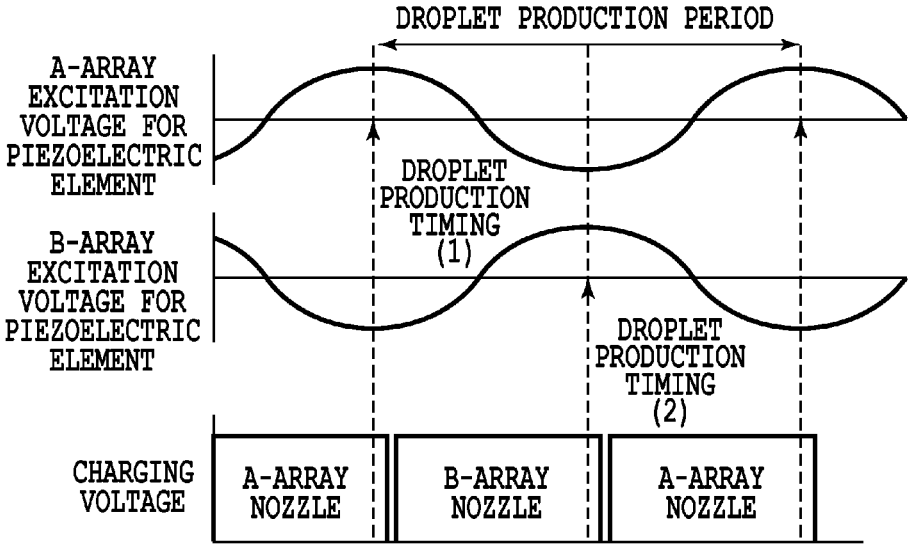
FIG. 6 is an illustrative view for a control method of charging voltage according to an embodiment of the present invention.

As shown in FIG. 6, when excitation voltages for the piezoelectric elements 01 belonging to the A-array group and the B-array group adjacent to each other, respectively, are shifted 180 degrees to each other in phase, droplet production timings of ink ejected from the respective nozzles 07 belonging to the A-array group and the B-array group are also shifted 180 degrees to each other in phase. And, a charging voltage is applied to the one or more charging electrodes 09 for one or more nozzles 07 of the A-array corresponding to image data via the one or more corresponding common wirings 10 in response to a timing (1) at which one or more ink droplets are produced from ink ejected from the nozzles 07 of the A-nozzle array. Then, the liquid droplets having a charge amount in response to the voltage is/are separated from ink columns from the nozzles 07 of the A-group and fly. When the charging voltage is applied, an electric field generated by the charging voltage for the one or more nozzles 07 of the A-array group is also applied to one or more ink columns from the nozzles 07 of the B-group; however, no liquid droplet is produced from the ink columns from the nozzles 07 of the B-group. And then, a charging voltage is applied to the one or more charging electrodes for the one or more nozzles 07 of the B-array group corresponding to image data via the one or more corresponding common wirings 10, and then one or more ink droplets, having a charge amount in response to the voltage, are separated from one or more ink columns from the one or more nozzles 07 of the B-group and fly. In short, in the present embodiment, one or more piezoelectric elements (a first driving unit) 01 belonging to the A-array group and one or more piezoelectric elements (a second driving unit) 01 belonging to the B-array group of all of piezoelectric elements 01 are driven with a different phase from each other, and a charging voltage applied to each of the plurality of the common wirings 10 is controlled.

As described above, each two charging electrodes adjacent to each other, which are corresponding to paired nozzles of the A-array group and the B-array-group, are electrically connected to each other and to one of the common wirings 10 to be extended to outside, so that each of the liquid droplets can be charged and the number of the wirings 10 to be extended to outside can be reduced to half. Thereby, a wiring pitch between the common wirings 10 can be doubled so that it facilitates to ensure electrical insulation therebetween. Further, in the control circuit, the number of output points for outputting a charging voltage and connecting points with the common wirings 10 also can be reduced to half so that costs of the control circuit can be decreased.

It should be noted that droplet production timings of the nozzles of the A-array nozzle group and the B-array nozzle group are shifted 180 degrees to each other, as mentioned above, so that landing positions of ink droplets of both groups on a print medium are displaced a half-dot distance from each other in a medium conveying direction. However, the displacement between the landing positions can be corrected by a positional shift of a half-dot distance between both nozzle arrays in the medium conveying direction.

In the embodiment described above, an explanation was made in the case where two corresponding charging electrodes 09 between the nozzle groups adjacent to each other are electrically connected to each other and to a corresponding common wiring 10 to be extended to outside. However, given nozzles 09 between nozzle arrays belonging to different groups, respectively, also can be connected to each other and to a common wiring 10 to be extended outside so that a charging voltage is applied to the common wiring 10 depending on image data.

Figure 7:
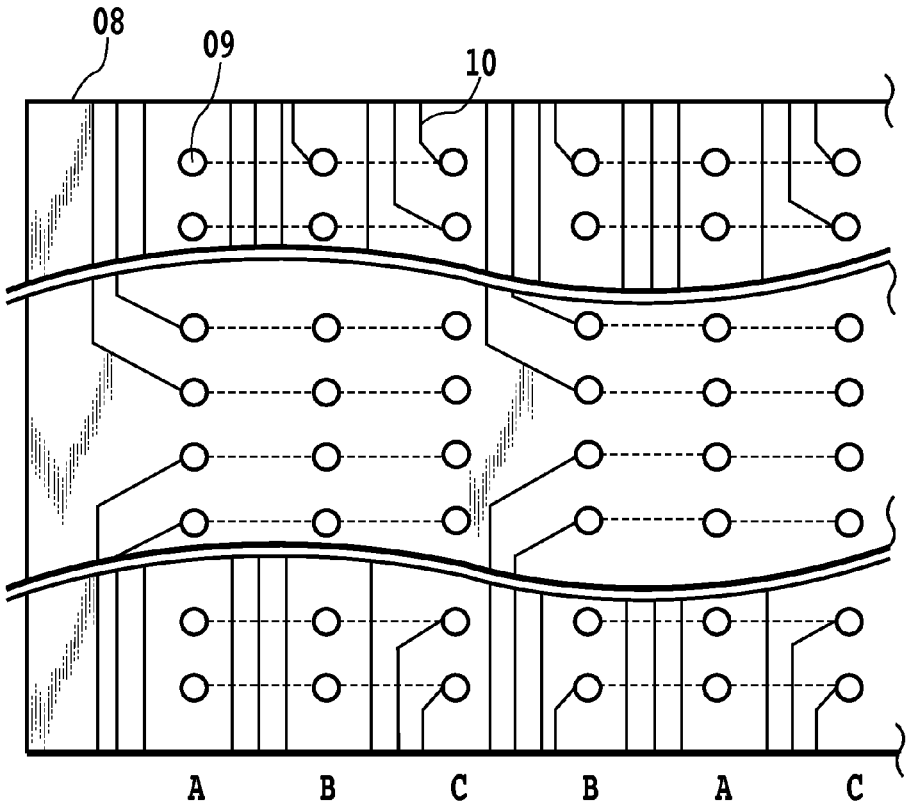
FIG. 7 is a plan view showing another example of charging electrodes and wirings.
Figure 8:
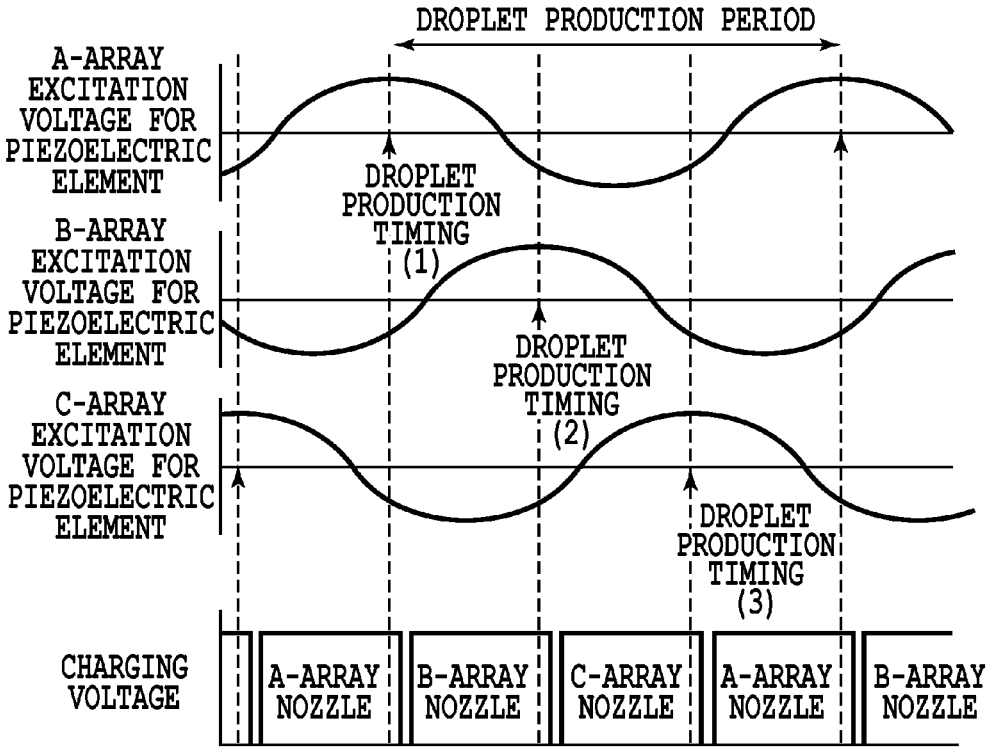
FIG. 8 is an illustrative view for explaining a control method of charging voltage according to another embodiment of the present invention.
Figure 9:
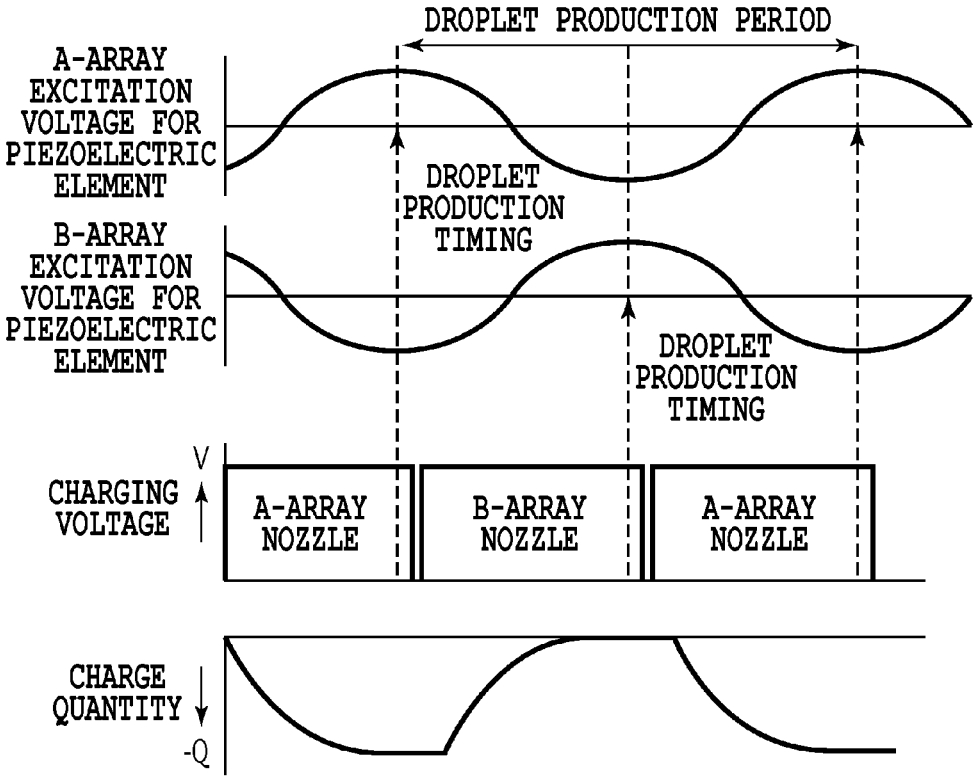
FIG. 9 is an illustrative view showing a relationship between an applying timing of charging voltage and charge quantity in the present invention.

In the embodiment described above, an explanation was made in the case where the nozzle arrays are divided into two groups of A and B to be driven. However, the nozzle arrays can be divided into a further large number of groups to be driven. In addition, the number of the wirings also can be further reduced by increasing the division number of the nozzle arrays. For example, as shown in FIG. 7, three nozzle arrays are divided into three groups A, B and C, and three charging electrodes belonging to the different groups, respectively, are electrically connected to each other and to a common wiring to be extended to outside. And, as shown in FIG. 8, the respective piezoelectric elements 01 which belong to the respective groups are supplied with excitation waves shifted 120 degrees in phase to each other to be driven. In particular, a charging voltage corresponding to image data for the A-nozzle array is applied to one or more charging electrodes 09 via one or more common wirings 10 in accordance with a timing (1) at which ink droplet is produced from ink ejected from one or more nozzles 07 of the A-nozzle array. Thereby, one or more ink droplets having a charge amount depending on the charge voltage are separated from one or more ink columns from the ink nozzles 07 of the A-nozzle array and fly. When the charging voltage for the one or more A-array nozzles is applied, the voltage is also applied to one or more ink columns ejected from one or more nozzles of the B-array and C-array, but no ink droplet is produced from the ink columns. Subsequently, a charging voltage is applied to one or more common wirings 10 corresponding to image data for the B-array nozzles 07, and one or more ink droplets having a charge amount depending on the charge voltage are separated from one or more ink columns from the B-array nozzles 07 when reaching a droplet production timing (2) and fly. Further, a charging voltage is applied to one or more common wirings 10 corresponding to image data for the C-array nozzles 07, and one or more ink droplets having a charge amount depending on the charge voltage are separated from one or more ink columns from the B-array nozzles 07 when reaching a droplet production timing (3) and fly. The number of the wirings to be extended outside can be reduced one third by this configuration.

Next, an explanation regarding conductivity and charge of ink when an ink column continuously ejected from the nozzle 07 is charged, and an ink droplet is separated therefrom and flies will be made.

When a voltage is applied to the charging electrode 09, an electric currency flows through a capacitance formed between the ink column ejected from the nozzle 07 and the charging electrode and a resistance of the ink thereby the ink column is charged in opposite polarity to the charging electrode 09. An ink droplet is separated from the ink column by an oscillation generated by the piezoelectric element 01 to which an excitation voltage is applied. And the ink droplet holds charges at that time and flies.

Figure 10:
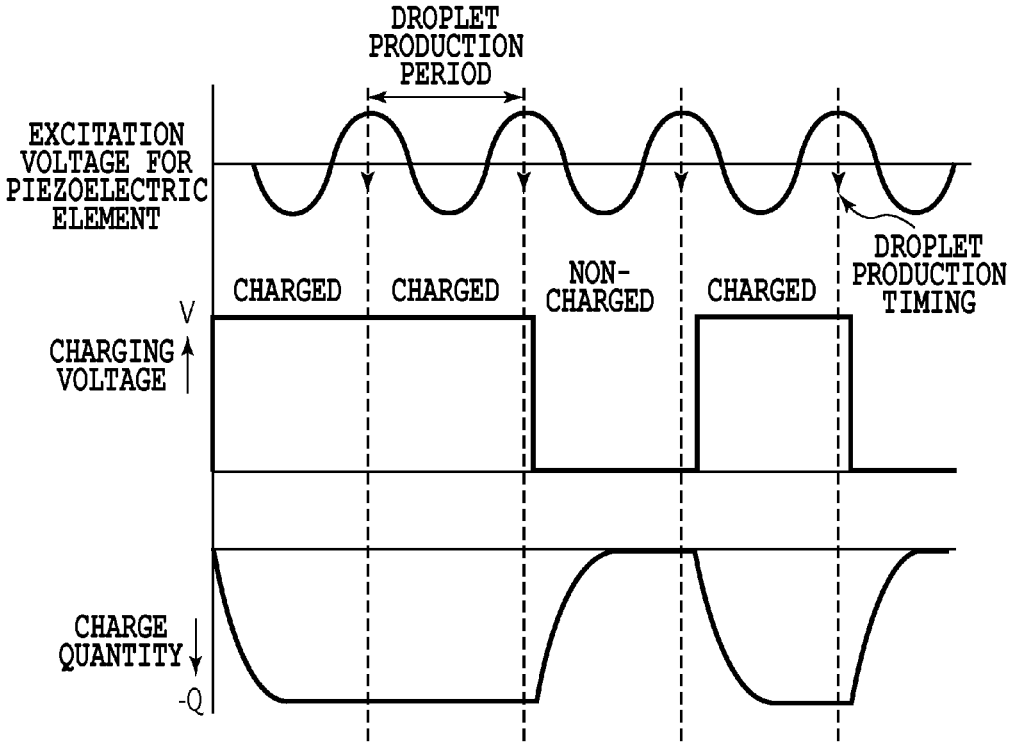
FIG. 10 is an illustrative view showing a relationship between an applying timing of charging voltage and charge quantity in the conventional art.

In a conventional inkjet printing head, as shown in FIG. 10, a voltage is applied to a charging electrode depending on a production timing of a droplet and an ink column is gradually charged with a time constant defined by a capacitance formed between an ink column ejected from a nozzle and a charging electrode and a resistance of ink. The resistance is controlled so that ink having a stable charge amount at the production timing flies. For example, a design is made such that a liquid droplet is subjected to a deflection of 500 μm at a position of a print medium, to deflect charged ink with an electric field and collect in a gutter. If 99 percent of the charges are discharged and one percent of the charges remain when an ink droplet is produced from ink to be used for printing, the ink droplet which should go straight is deflected so that a landing position thereof on a print medium is deviated about 5 μm.

An acceptable range of image degradation due to deviations of landing positions of ink droplets is generally defined within a half of a printed dot and the deviations of landing position should be less than or equal to 5 μm when printing at 2400-dpi. If an acceptable value of a landing deviation on a print medium due to a charge of an ink droplet is set to 5 μm, and a charging voltage is applied depending on a production timing of a droplet, more than 99 percent of charge and discharge should be completed in one production period of a droplet. To attain this, it is necessary to decrease a resistance of ink such that a time constant defined by a capacitance and a resistance is less than or equal to 1/4.6 of the one production period of a droplet. In reality, a deviation between an excitation wave and a production timing of a droplet may occur; therefore, it is necessary to further decrease the resistance of ink including a time of the deviation. To provide conductivity to ink so as to decrease a resistance thereof, an addition of electrical conducting material to the ink is mainly performed. This is dissociated in the ink and ionized so as to carry electric charges. For example, a material such as lithium nitrate can be used.

In the case where the charging electrodes 09 are time-shared as the present embodiment, a plurality of times of charge and discharge should be done in one production period of a droplet. In the case where the nozzle-arrays are divided into two groups and each is driven at different timings, it is necessary to complete one charge and discharge in a half of the one production period of a droplet. Therefore, in the present invention, a charging voltage to charge one or more charging electrodes belonging to one group of the A-array and B-array groups is applied through one or more common wirings, after each charged amount of liquid droplets flying from one or more nozzles belonging to the other group of exceeds a predetermined amount. For example, the predetermined charged amount is a value such that a landing deviation of an ink droplet on a print medium is less than or equal to a setting such as 5 μm.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-035127, filed Feb. 19, 2010, which is hereby incorporated by reference herein in its entirety.

What is claimed is:

1. A printing apparatus comprising:

a liquid ejecting head comprising:

a plurality of nozzles including a plurality of first nozzles belonging to a first group and a plurality of second nozzles belonging to a second group, a driving unit configured to cause liquid to be ejected from each of the plurality of nozzles and to fly as liquid droplets, the driving unit including a first driving unit corresponding to the plurality of first nozzles and a second driving unit corresponding to the plurality of second nozzles, a plurality of charging electrodes configured to selectively charge flying liquid droplets from each of the plurality of nozzles, a deflecting electrode configured to form an electric field to deflect each liquid droplet charged by the plurality of charging electrodes, and a plurality of common wirings, one of the plurality of common wirings being electrically connected commonly to one of a plurality of first charging electrodes and one of a plurality of second charging electrodes of the plurality of charging electrodes and another of the plurality of common wirings being connected to another of the plurality of first charging electrodes and another of the plurality of second charging electrodes of the plurality of charging electrodes; and a controller configured to control so as to drive the first driving unit and the second driving unit at different phases from each other, and to apply a charging voltage to each of the plurality of the first charging electrodes and the plurality of the second charging electrodes via the plurality of the common wirings.

2. The printing apparatus according to claim 1, wherein the controller applies the charging voltage for charging electrodes corresponding to nozzles in one of the first and second groups to the common wirings after a charged amount of a flying liquid droplet from a nozzle belonging to the other of the first and second groups exceeds a predetermined amount.

3. The printing apparatus according to claim 1, wherein the liquid ejecting head comprises a plurality of nozzle arrays having the plurality of nozzles, wherein nozzle arrays belonging to a common group of the plurality of nozzle arrays are oscillated by a common driving unit of the first and second driving units.

4. The printing apparatus according to claim 3, wherein the plurality of nozzle arrays alternately belong to the first group and the second group in an array direction of the plurality of nozzle arrays.

5. The printing apparatus according to claim 4, wherein each of the first charging electrodes for the nozzle arrays belonging to the first group and each of the corresponding second charging electrodes for the nozzle arrays adjacent thereto and belonging to the second group are electrically connected to each other and electrically connected to one of the common wirings, respectively.

6. The printing apparatus according to claim 5, wherein the controller controls to shift production timings of droplets of the first driving unit for oscillating the nozzle array of the first group and the second driving unit for oscillating the nozzle array of the second group from each other, and alternately to apply the charging voltage corresponding to printing data for a nozzle array belonging to the first group and the charging voltage corresponding to printing data for a nozzle array belonging to the second group to each of the first and second charging electrodes electrically connected to the common wirings.

7. The printing apparatus according to claim 3, wherein the plurality of the nozzle arrays are divided into at least three groups, wherein at least three corresponding charging electrodes for different nozzle arrays belonging to the at least three groups are electrically connected to each other and electrically connected to one of the common wirings, and wherein the controller controls to shift production timings of droplets of a plurality of driving units for oscillating the respective nozzle arrays of the at least three groups from each other, and sequentially apply the charging voltage to the respective charging electrodes electrically connected to the common wirings.

8. The printing apparatus according to claim 1, wherein the driving unit comprises a piezoelectric element.

9. The printing apparatus according to claim 1, wherein the controller performs an on/off control of a switch for an electric power supply used for charging and a switch for an electric power supply used for deflecting in accordance with printing data.

10. A driving method of a liquid ejecting head, comprising:

providing a liquid ejecting head, the liquid ejecting head comprising:

a plurality of nozzles including a plurality of first nozzles belonging to a first group and a plurality of second nozzles belonging to a second group, a driving unit configured to cause liquid to be ejected from each of the plurality of nozzles and to fly as liquid droplets, the driving unit including a first driving unit corresponding to the plurality of first nozzles and a second driving unit corresponding to the plurality of second nozzles, a plurality of charging electrodes configured to selectively charge flying liquid droplets from each of the plurality of nozzles, a deflecting electrode configured to form an electric field so as to deflect each liquid droplet charged by the plurality of charging electrodes, and a plurality of common wirings, one of the plurality of common wirings being electrically connected commonly to one of a plurality of first charging electrodes and one of a plurality of second charging electrodes of the plurality of charging electrodes and another of the plurality of common wirings being connected to another of the plurality of first charging electrodes and another of the plurality of second charging electrodes of the plurality of charging electrodes; and controlling so as to drive the first driving unit and the second driving unit at different phases from each other, and to apply a charging voltage to each of the plurality of the first charging electrodes and the plurality of the second charging electrodes via the plurality of the common wirings.

* * * * *